US011376874B2

(12) United States Patent
Motai et al.

(10) Patent No.: US 11,376,874 B2
(45) Date of Patent: Jul. 5, 2022

(54) HALF CUTTER, METHOD OF MANUFACTURING HALF CUTTER, AND TAPE PRINTING DEVICE

(71) Applicant: SEIKO EPSON CORPORATION, Tokyo (JP)

(72) Inventors: Kenji Motai, Matsumoto (JP); Tadashi Inaba, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 208 days.

(21) Appl. No.: 16/625,156

(22) PCT Filed: Jun. 11, 2018

(86) PCT No.: PCT/JP2018/022185
§ 371 (c)(1),
(2) Date: Dec. 20, 2019

(87) PCT Pub. No.: WO2018/235646
PCT Pub. Date: Dec. 27, 2018

(65) Prior Publication Data

US 2021/0331342 A1 Oct. 28, 2021

(30) Foreign Application Priority Data

Jun. 22, 2017 (JP) ..... JP2017-121944

(51) Int. Cl.
*B41J 11/66* (2006.01)
*B26D 1/06* (2006.01)
(Continued)

(52) U.S. Cl.
CPC ..... *B41J 11/66* (2013.01); *B26D 1/06* (2013.01); *B26D 1/305* (2013.01); *B41J 11/00* (2013.01); *B41J 11/70* (2013.01)

(58) Field of Classification Search
CPC .. B41J 11/00; B41J 11/66; B41J 11/70; B62D 1/06; B62D 1/305
See application file for complete search history.

(56) References Cited

U.S. PATENT DOCUMENTS 5,271,789 A 12/1993 Takagi et al.
5,957,597 A 9/1999 Kato
(Continued)

FOREIGN PATENT DOCUMENTS

JP S62-153067 A 7/1987
JP H06-091600 A 4/1994
(Continued)

OTHER PUBLICATIONS

International Search Report dated Jul. 10, 2018 in PCT/JP2018/022185 with English-language translation (4 pgs.).

*Primary Examiner* — Jill E Culler
(74) *Attorney, Agent, or Firm* — Oliff PLC

(57) ABSTRACT

A half cutter includes a cutting blade having a blade and a holder to which the blade is fixed, a blade receiving member having a blade receiving surface from and with which the blade is separated and comes into contact, and a spacer having at least one of a holder spacer arranged at the holder which is made of a material that is different from a material of the holder, is provided in the holder to protrude toward the blade receiving surface further than the blade, and generates a gap between the blade and the blade receiving surface and a blade receiving spacer arranged at the blade receiving surface which is made of a material different from a material of the blade receiving member, is provided to protrude from the blade receiving surface, and generates a gap between the blade and the blade receiving surface.

6 Claims, 19 Drawing Sheets

(51) Int. Cl.

| | |
|---|---|
| ***B26D 1/30*** | (2006.01) |
| ***B41J 11/00*** | (2006.01) |
| ***B41J 11/70*** | (2006.01) |

(56) References Cited

U.S. PATENT DOCUMENTS

| | | | | |
|---|---|---|---|---|
| 9,145,009 | B2 | 9/2015 | Takahashi | |
| 2002/0067943 | A1* | 6/2002 | Furuya | B41J 11/666<br>400/621 |
| 2005/0061132 | A1* | 3/2005 | Sodeyama | B26D 7/26<br>83/694 |
| 2013/0202342 | A1* | 8/2013 | Kosuge | B41J 11/703<br>400/621 |
| 2013/0287467 | A1 | 10/2013 | Takahashi | |

FOREIGN PATENT DOCUMENTS

| | | | |
|---|---|---|---|
| JP | H07-119135 | B2 | 12/1995 |
| JP | H11-170638 | A | 6/1999 |
| JP | 2010-064156 | A | 3/2010 |
| JP | 5945978 | B2 | 7/2016 |
| WO | 2012/133247 | A1 | 10/2012 |

* cited by examiner

HALF CUTTER, METHOD OF MANUFACTURING HALF CUTTER, AND TAPE PRINTING DEVICE

TECHNICAL FIELD

The present invention relates to a half cutter which half-cuts an object to be cut, that is, forms a cut on one surface of the object to be cut without cutting the object to be cut, a method of manufacturing a half cutter, and a tape printing device.

BACKGROUND ART

In the related art, as disclosed in PTL 1, a half cutter (a partial cutting device) has been known which includes a cutting blade having a blade (a cutting blade) and a holder (a support member) to which the blade is fixed and a blade receiving member (a cradle) having a blade receiving surface (a bottom surface of a step) with which the blade comes in contact. The blade receiving surface is formed with a pair of spacers (steps) that generate a gap between the blade and the blade receiving surface in a state in which the blade comes close to the blade receiving surface. These spacers are made of the same material as the blade receiving member, for example, by press working. In this paragraph, the wording in parentheses indicates the name of PTL 1.

CITATION LIST

Patent Literature

PTL 1: Japanese Unexamined Patent Application Publication No. 11-170638

SUMMARY OF INVENTION

Technical Problem

As in a half cutter according to the related art, when spacers are made of the same material as a blade receiving member, for example, by press working, the protrusion height of the spacers is easy to deviate from the dimensional tolerance. Therefore, a gap between a blade and a blade receiving surface deviates from an appropriate value, and thus, an object to be cut cannot be half-cut appropriately.

An objective of the present invention is to provide a half cutter that can appropriately half-cut an object to be cut, a method of manufacturing a half cutter, and a tape printing device.

Solution to Problem

There is provided a half cutter according to the present invention including a cutting blade having a blade and a holder to which the blade is fixed, a blade receiving member having a blade receiving surface from and with which the blade is separated and comes into contact, and a spacer having at least one of a holder spacer arranged at the holder which is made of a material that is different from a material of the holder, is provided in the holder to protrude toward the blade receiving surface further than the blade, and generates a gap between the blade and the blade receiving surface in a state in which the blade comes close to the blade receiving surface and a blade receiving spacer arranged at the blade receiving surface which is made of a material different from a material of the blade receiving member, is provided to protrude from the blade receiving surface, and generates a gap between the blade and the blade receiving surface in a state in which the blade comes close to the blade receiving surface.

With this configuration, since the spacer is made of the material that is different from the material of the holder and is provided in the holder or is made of the material that is different from the blade receiving member and is provided on the blade receiving surface, the protrusion height of the spacer is prevented from deviating from a dimensional tolerance. Therefore, the gap between the blade and the blade receiving surface can be prevented from deviating from an appropriate value, and an object to be cut can be appropriately half-cut.

In this case, a cutting edge of the blade may be flush with an end surface of the holder on the blade receiving surface.

With this configuration, the blade can be fixed to the holder with high accuracy.

In this case, the spacer may have the blade receiving spacer arranged at the blade receiving surface.

With this configuration, the spacer can be appropriately provided.

In this case, a plurality of the spacers may be provided to be spaced apart from each other in a cutting edge direction of the blade in a state in which the blade comes close to the blade receiving surface.

With this configuration, a gap between the blade and the blade receiving surface can be appropriately formed over the entire cutting edge direction of the blade.

There is provided a method of manufacturing a half cutter according to the present invention, the half cutter including a cutting blade having a blade and a holder to which the blade is fixed, a blade receiving member having a blade receiving surface from and with which the blade is separated and comes into contact, and a spacer which generates a gap between the blade and the blade receiving surface in a state in which the blade comes close to the blade receiving surface, the method including forming the spacer in the holder to protrude toward the blade receiving surface further than the blade with a material that is different from a material of the holder or forming the spacer to protrude from the blade receiving surface with a material that is different from a material of the blade receiving member.

With this configuration, since the spacer is made of the material that is different from the material of the holder and is provided in the holder or is made of the material that is different from the blade receiving member and is provided on the blade receiving surface, the protrusion height of the spacer is prevented from deviating from a dimensional tolerance. Therefore, the gap between the blade and the blade receiving surface can be prevented from deviating from an appropriate value, and an object to be cut can be appropriately half-cut.

In this case, the spacer may be formed by a surface treatment on the holder or the blade receiving surface.

With this configuration, the spacer can be formed efficiently.

In this case, the surface treatment may be a plating treatment.

With this configuration, dimensional accuracy of the protrusion height of the spacer can be improved.

There is provided a tape printing device including a printing unit that performs printing on a printing tape of a laminated tape having the printing tape and a peeling tape laminated on the printing tape, and a half cutter that forms a cut on a surface of one of the printing tape and the peeling tape with respect to the laminated tape, in which the half cutter includes a cutting blade having a blade and a holder to which the blade is fixed, a blade receiving member having a blade receiving surface from and with which the blade is separated and comes into contact, and a spacer having at least one of a holder spacer arranged at the holder which is made of a material that is different from a material of the holder, is provided in the holder to protrude toward the blade receiving surface further than the blade, and generates a gap between the blade and the blade receiving surface in a state in which the blade comes close to the blade receiving surface and a blade receiving spacer arranged at the blade receiving surface which is made of a material different from a material of the blade receiving member, is provided to protrude from the blade receiving surface, and generates a gap between the blade and the blade receiving surface in a state in which the blade comes close to the blade receiving surface.

With this configuration, since the spacer is made of the material that is different from the material of the holder and is provided in the holder or is made of the material that is different from the blade receiving member and is provided on the blade receiving surface, the protrusion height of the spacer is prevented from deviating from a dimensional tolerance. Therefore, the gap between the blade and the blade receiving surface can be prevented from deviating from an appropriate value, and the laminated tape can be appropriately half-cut.

DESCRIPTION OF EMBODIMENTS

Hereinafter, one embodiment of a half cutter, a method of manufacturing the half cutter, and a tape printing device of the present invention will be described. In the following drawing, an XYZ orthogonal coordinate system is displayed to clarify an arrangement relationship between components as needed. However, it is obvious that this fact does not limit the present invention.

Figure 1:
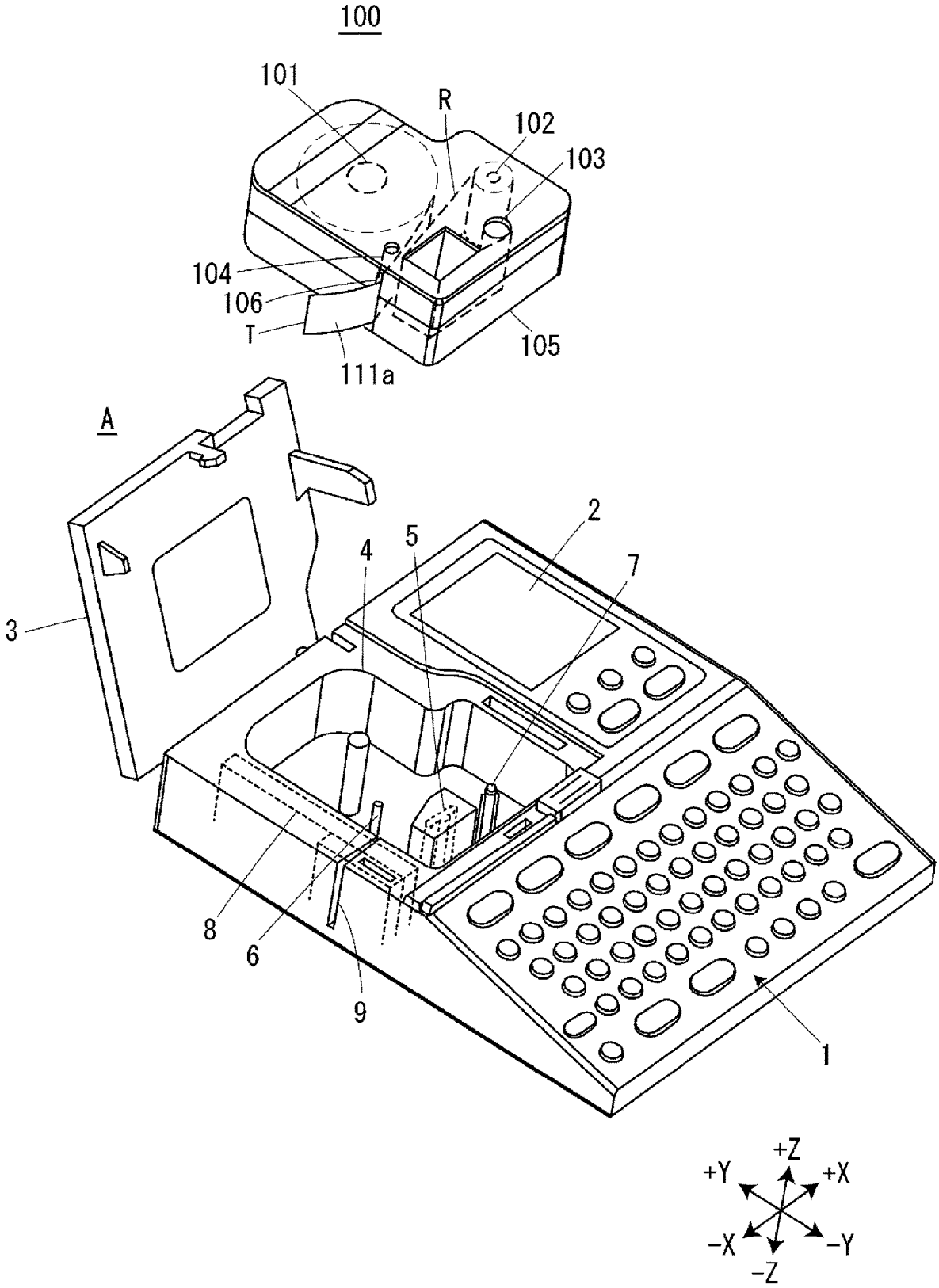
FIG. 1 is a perspective view of a tape printing device according to an embodiment of the present invention.

A schematic configuration of a tape printing device A will be described based on FIG. 1. The tape printing device A includes an operation panel 1, a display 2, a cover 3, a cartridge mounting unit 4, a printing head 5, a platen shaft 6, a winding shaft 7, and a cutter unit 8.

The operation panel 1 is provide with various buttons such as a character button, a selection button, and a printing button, and receives various operations such as a character input operation, an option selection operation, and a printing execution instruction operation. The display 2 displays a character and various options input from the operation panel 1.

The cover 3 opens and closes the cartridge mounting unit 4. The cover 3 is opened and closed when a user attaches and detaches a tape cartridge 100 to and from the cartridge mounting unit 4. The tape cartridge 100 is detachably mounted on the cartridge mounting unit 4.

The tape cartridge 100 includes a tape core 101, a ribbon feeding-out core 102, a ribbon winding core 103, a platen roller 104, and a cartridge case 105 that accommodates them. A laminated tape T is wound on the tape core 101 in a roll shape. An ink ribbon R is wound on the ribbon feeding-out core 102 in a roll shape. The cartridge case 105 is provided with a tape sending-out port 106 through which the laminated tape T is sent out.

The cartridge mounting unit 4 is provided with the printing head 5, the platen shaft 6, and the winding shaft 7.

When the tape cartridge 100 is mounted on the cartridge mounting unit 4, the platen roller 104 and the ribbon winding core 103 are inserted into the platen shaft 6 and the winding shaft 7, respectively. Subsequently, when the cover 3 is closed, the printing head 5 moves toward the platen roller 104, and the laminated tape T and the ink ribbon R are sandwiched between the printing head 5 and the platen roller 104.

In this state, when the printing execution instruction operation is performed, a feeding motor (not illustrated) is operated and the platen roller 104 and the ribbon winding core 103 rotate. Thus, the laminated tape T is fed out from the tape core 101 and is sent to a tape discharge port 9 through the tape sending-out port 106, and the ink ribbon R is fed out from the ribbon feeding-out core 102 and is wound on the ribbon winding core 103. At this time, as the printing head 5 generates heat, ink of the ink ribbon R is transferred to the laminated tape T, and a printing image such as a character input from the operation panel 1 is printed on the laminated tape T.

The cutter unit 8 is provided between the cartridge mounting unit 4 and the tape discharge port 9. The cutter unit 8 includes a full cutter (not illustrated) and a half cutter 20 (see FIG. 3). The full cutter fully cuts the laminated tape T, that is, cuts the laminated tape T in the width direction of the laminated tape T. Accordingly, the printed portion of the laminated tape T sent from the tape cartridge 100 mounted on the cartridge mounting unit 4 to the tape discharge port 9 is cut off and is discharged from the tape discharge port 9. The half cutter 20 half-cuts the laminated tape T, that is, forms a cut C (see FIG. 2) on the surface of the laminated tape T in the width direction of the laminated tape T without completely cutting the laminated tape T. The half cutter 20 will be described later.

Figure 2:
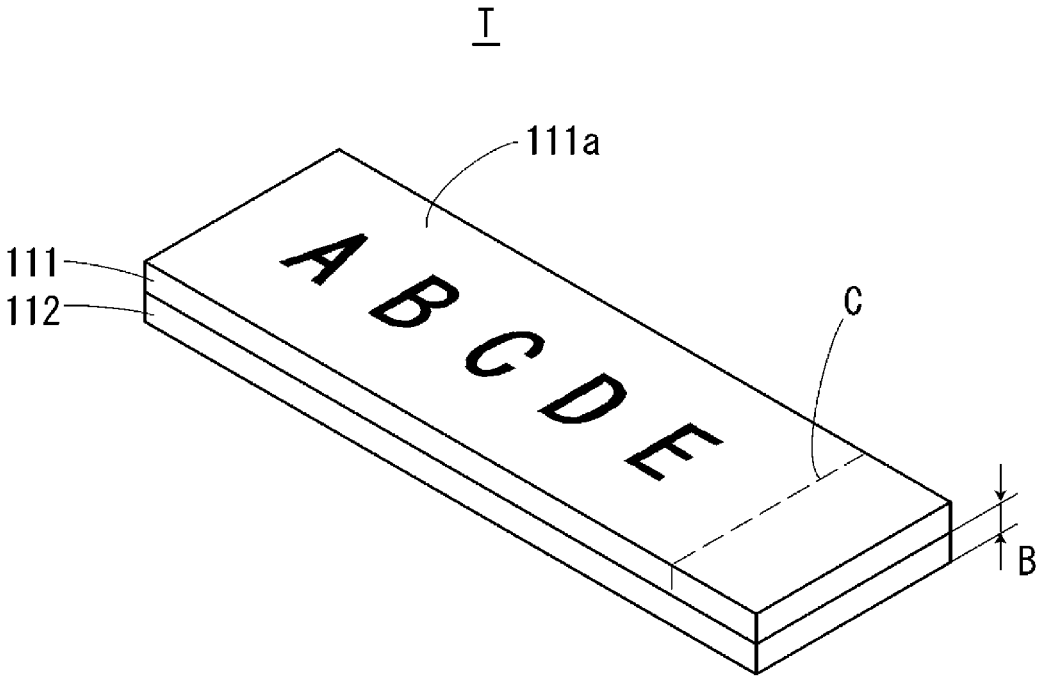
FIG. 2 is a perspective view of a laminated tape.

The laminated tape T will be described based on FIG. 2. The laminated tape T includes a printing tape 111 and a peeling tape 112 laminated on the printing tape 111. The laminated tape T is wound on the tape core 101 such that the printing tape 111 is provided on the outside and the peeling tape 112 is provided on the inside (see FIG. 1). The printing image is printed on a printing surface 111*a* of the printing tape 111 by the printing head 5. An adhesive is applied to an adhesive surface (not illustrated) of the printing tape 111, which is a surface opposite to the printing surface 111*a*. The peeling tape 112 is peelably attached to the adhesive surface of the printing tape 111. Although the thickness B of the peeling tape 112 is not particularly limited, the thickness B is, for example, 0.04 mm. The cut C is formed on the surface of the printing tape 111 side by the half cutter 20 with respect to the laminated tape T as configured above.

Figure 3:
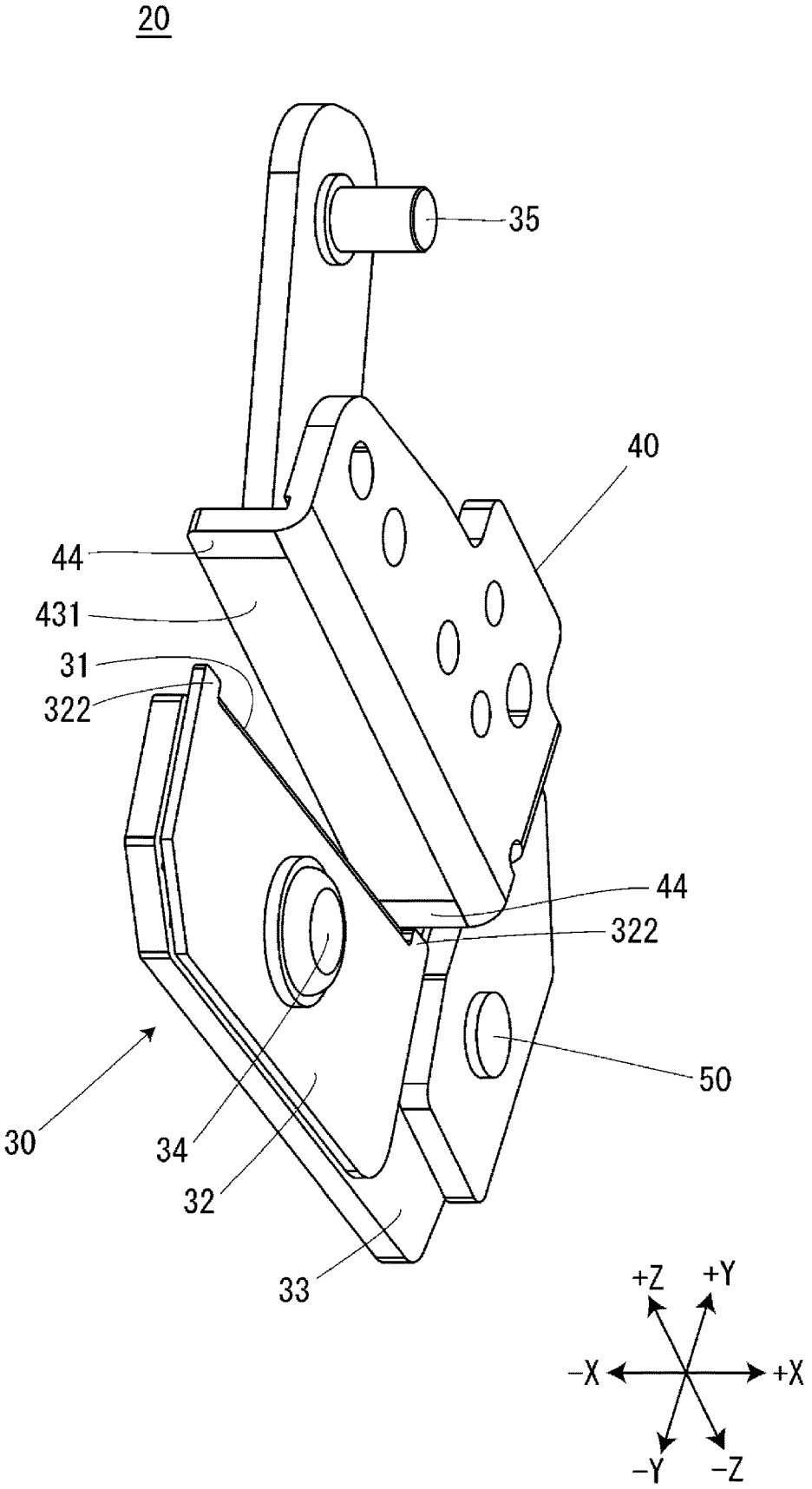
FIG. 3 is a perspective view of a half cutter according to the embodiment of the present invention.
Figure 4:
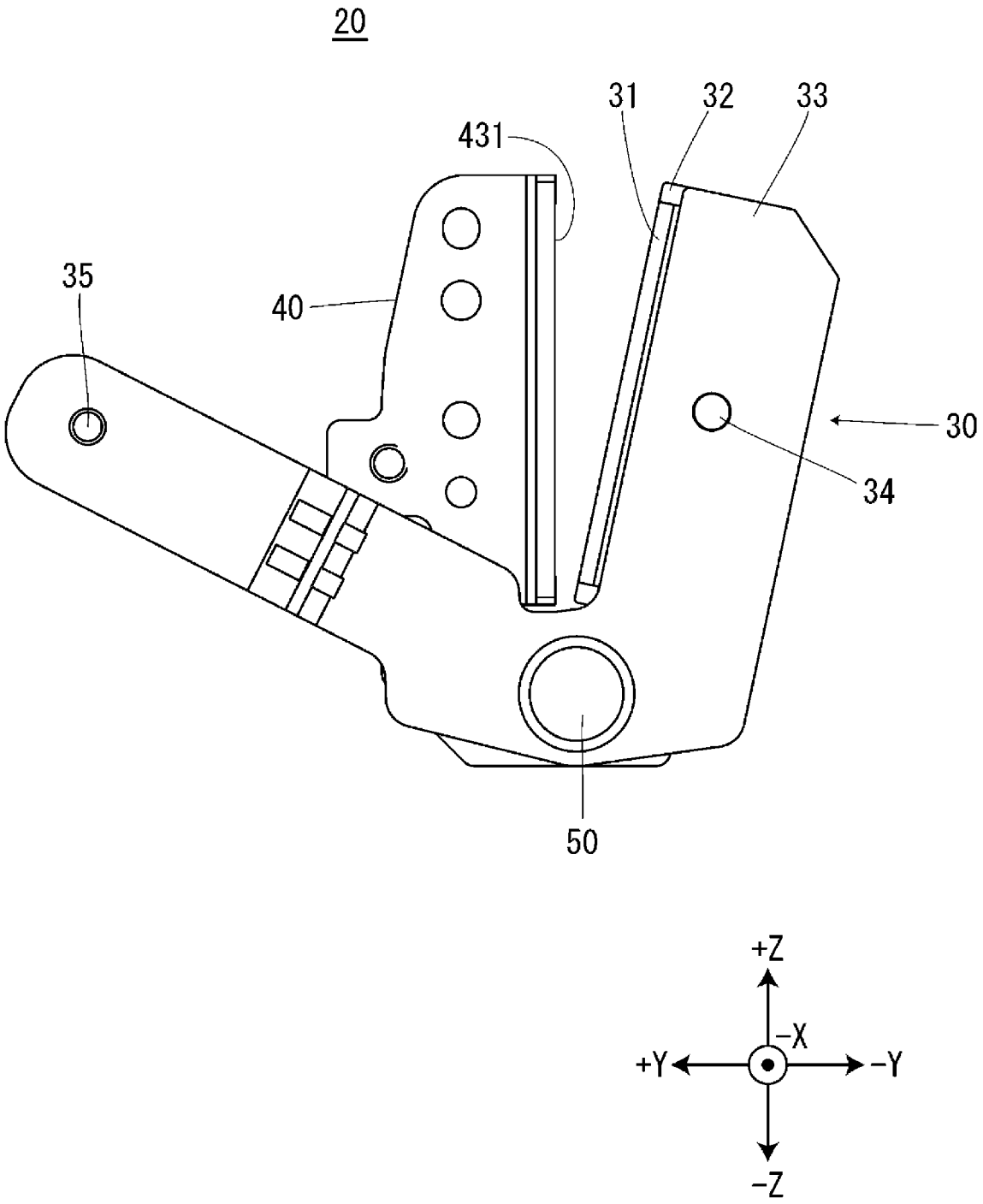
FIG. 4 is a view of a half cutter in a state in which a blade is separated from a blade receiving surface, when viewed from the −X side.
Figure 5:
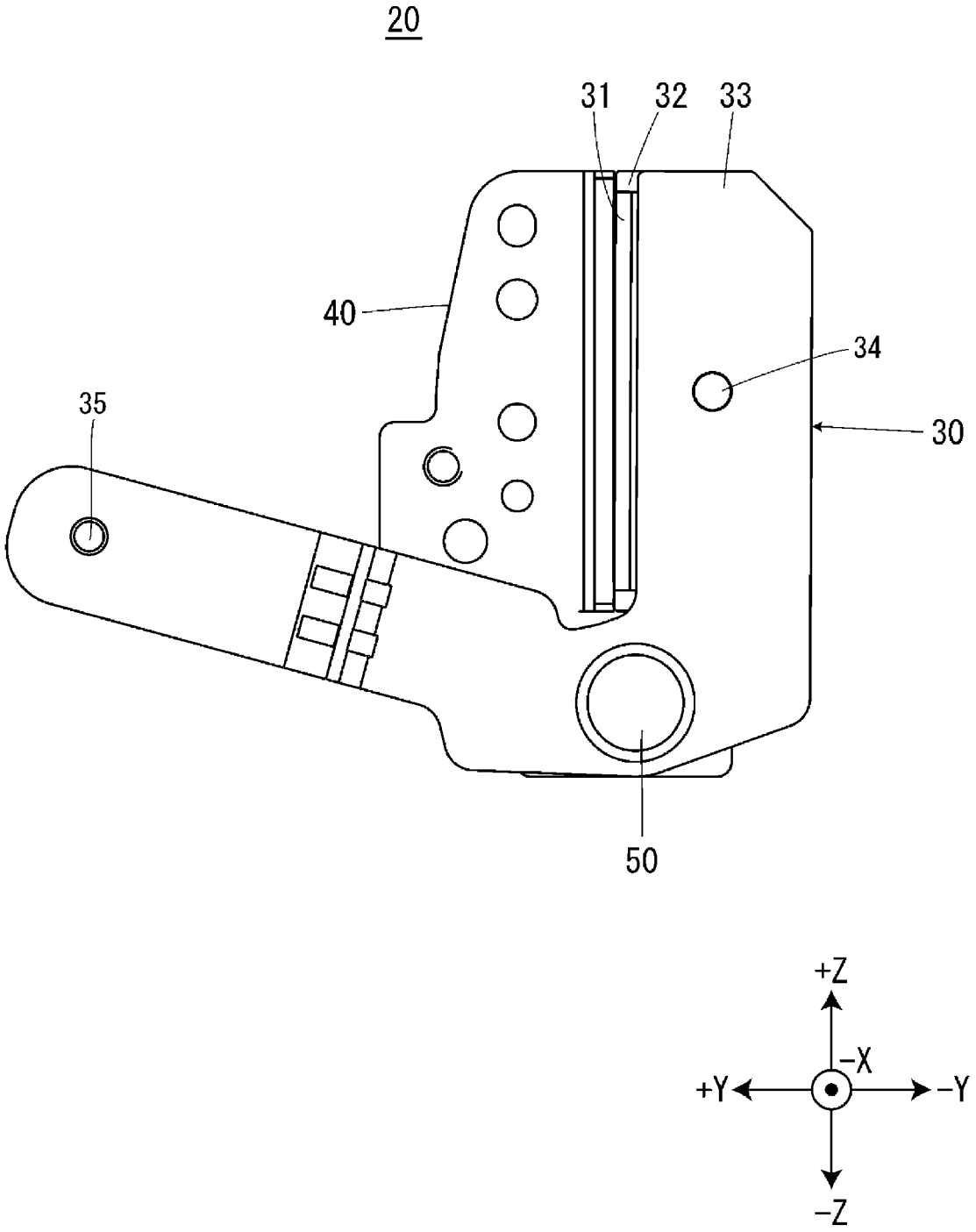
FIG. 5 is a view of the half cutter in a state in which the blade comes close to the blade receiving surface, when viewed from the −X side.

The half cutter 20 will be describe based on FIGS. 3 to 5. The half cutter 20 includes a cutting blade 30 and a blade receiving member 40.

The cutting blade 30 is rotatably supported on the blade receiving member 40 by a support shaft 50. The half cutter 20 half-cuts the laminated tape T sent between the cutting blade 30 and the blade receiving member 40 by rotating the cutting blade 30 about the blade receiving member 40, which is like scissors, using a cutter motor (not illustrated) as a driving source. The half cutter 20 may be configured such that the cutting blade 30 is rotated about the blade receiving member 40 in a manual manner.

The cutting blade 30 includes a blade 31, a holder 32, and a frame 33. The holder 32, the blade 31, and the frame 33 are provided in the order thereof from the upstream side (the +X side) in the feeding direction of the laminated tape T. The cutting blade 30 is provided such that the blade 31 faces the printing tape 111 side (the −Y side) of the laminated tape T sent to the half cutter 20.

Figure 6:
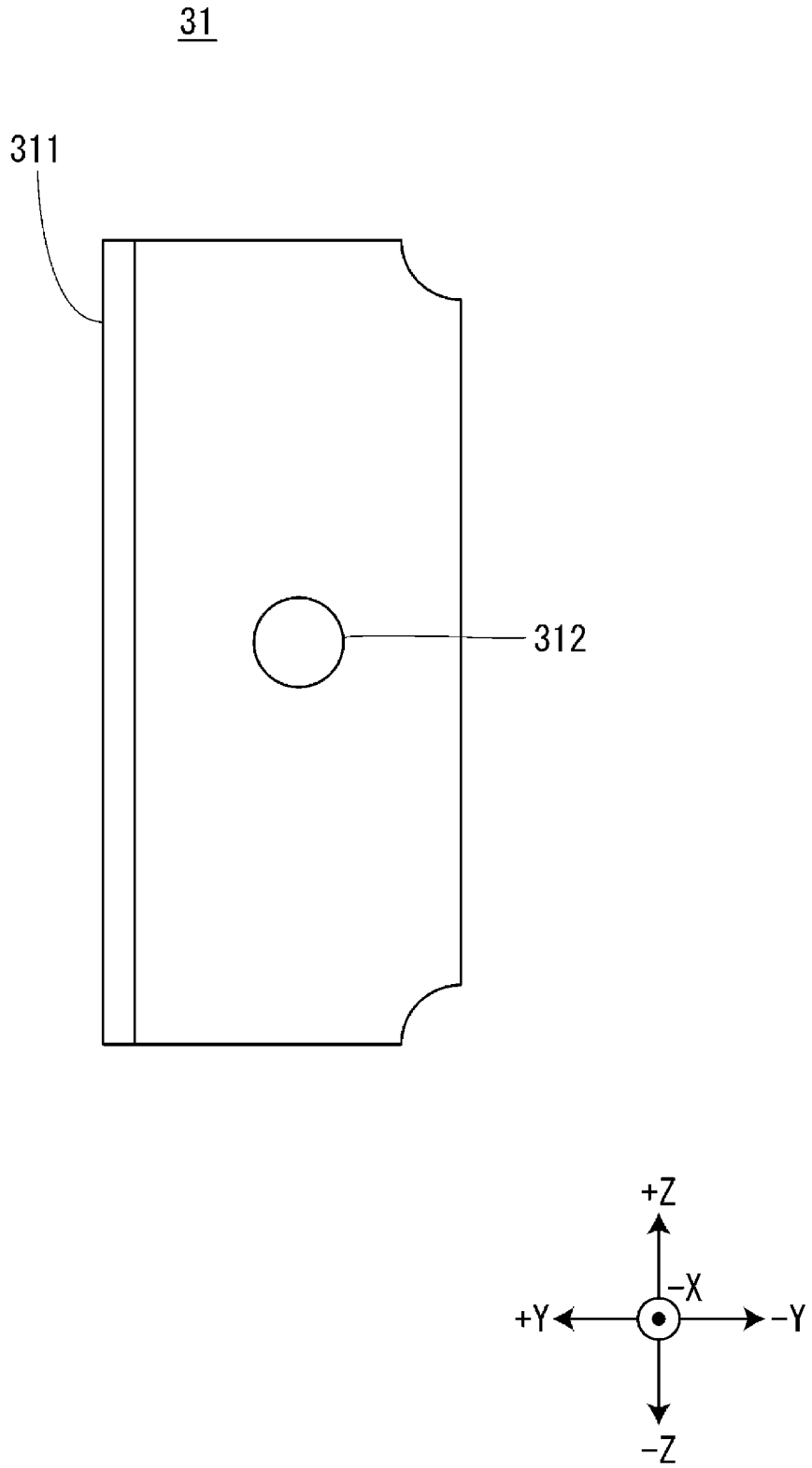
FIG. 6 is a view of the blade when viewed from the −X side.

The blade 31 will be described based on FIG. 6. The blade 31 is formed in a substantially rectangular plate shape that is long in the Z direction. The blade 31 has a linear cutting edge 311. A blade hole 312 into which an attachment pin 34 (see FIG. 3) is inserted is provided at a substantially central portion of the blade 31.

Figure 7:
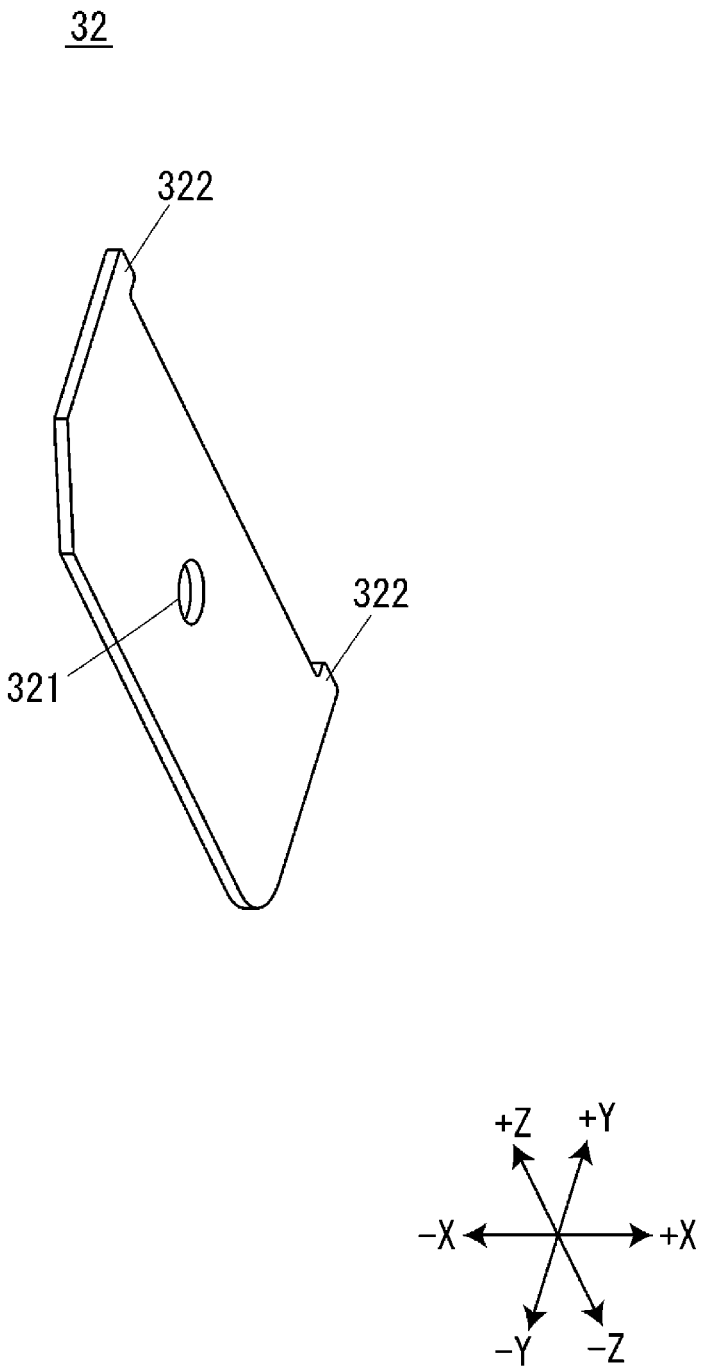
FIG. 7 is a perspective view of a holder.
Figure 8:
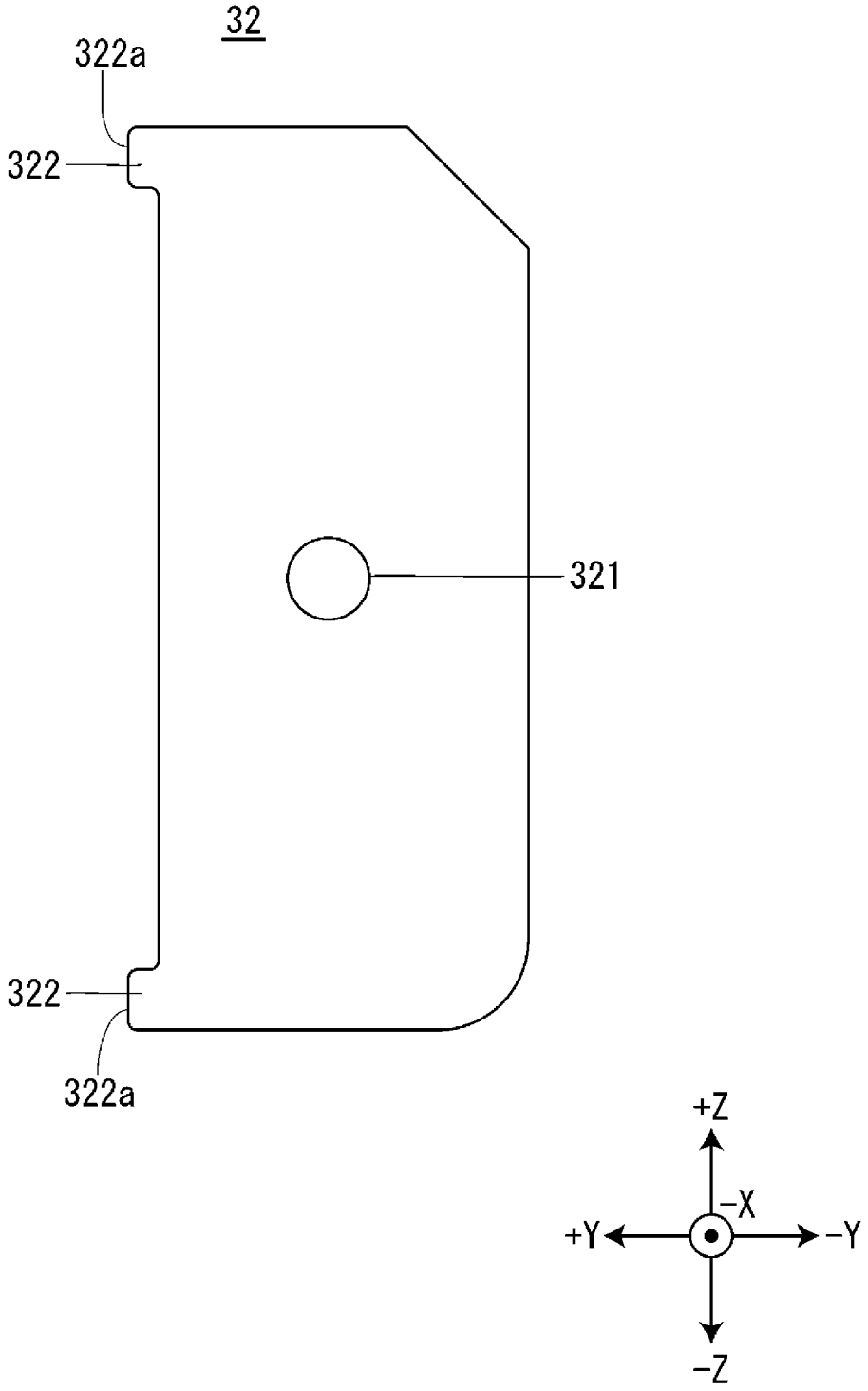
FIG. 8 is a view of the holder when viewed from −X side.

The holder 32 will be described based on FIGS. 7 and 8. The holder 32 is formed in a substantially rectangular plate shape that is larger than the blade 31 by one size and is long in the Z direction. A holder hole 321 into which the attachment pin 34 is inserted is provided at a substantially central portion of the holder 32. Holder protrusion portions 322 are provided at both ends of the holder 32 in the longitudinal direction, at an end portion of the holder 32 on the +Y side, that is, at an end portion on a blade receiving surface 431 (see FIG. 3) side. Although the material of the holder 32 is not particularly limited, the holder 32 is made of, for example, stainless steel.

Figure 9:
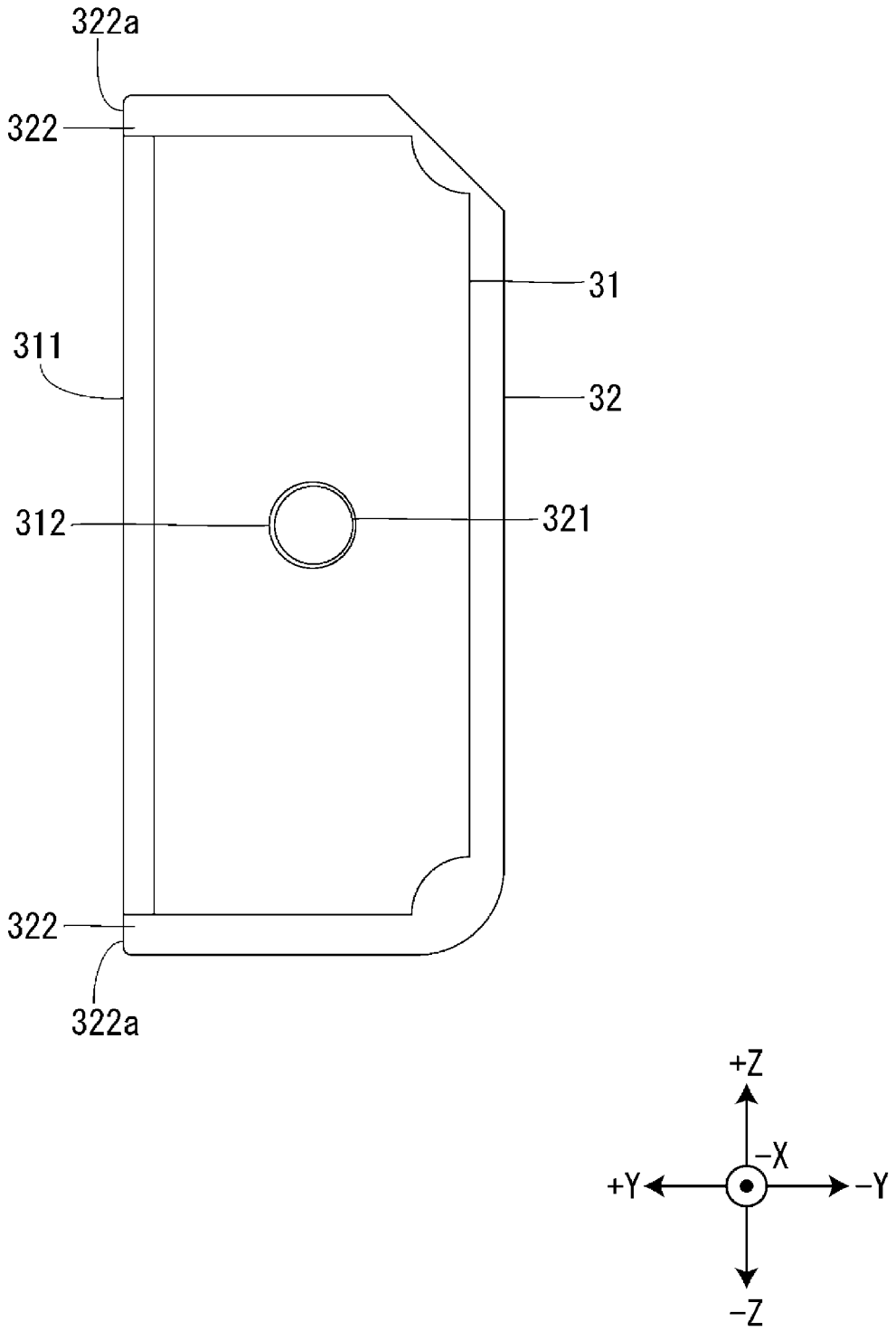
FIG. 9 is a view of the holder to which the blade is fixed, when viewed from the −X side.

The blade 31 and the holder 32 will be described based on FIG. 9. The blade 31 is fixed to a surface of the holder 32 on the downstream side (the −X side) of the laminated tape T in the feeding direction, for example, by spot welding. The blade 31 is fixed to the holder 32 such that a cutting edge direction of the blade 31, that is, an extending direction of the cutting edge 311 is substantially parallel to a longitudinal direction of the holder 32. In more detail, the blade 31 is positioned such that the cutting edge 311 is flush with an end surface of the holder 32 on the blade receiving surface 431 side (the +Y side), that is, tip end surfaces 322*a* of the holder protrusion portions 322. Then, the blade 31 is fixed to the holder 32. Therefore, the blade 31 can be fixed to the holder 32 with high accuracy. In other words, as compared to a case where the blade 31 is fixed to the holder 32 after the cutting edge 311 is positioned to be shifted with respect to the tip end surfaces 322*a* of the holder protrusion portions 322 by a predetermined amount, the blade 31 and the holder 32 can be easily assembled with each other, the dimensional error of the cutting edge 311 with respect to the tip end surfaces 322*a* of the holder protrusion portions 322 can be reduced, and a defect rate in a manufacturing process can be reduced. Although it is preferable that the cutting edge 311 and the tip end surfaces 322*a* are flush with each other, there may be a deviation within a range that is allowed for assembly.

Figure 10:
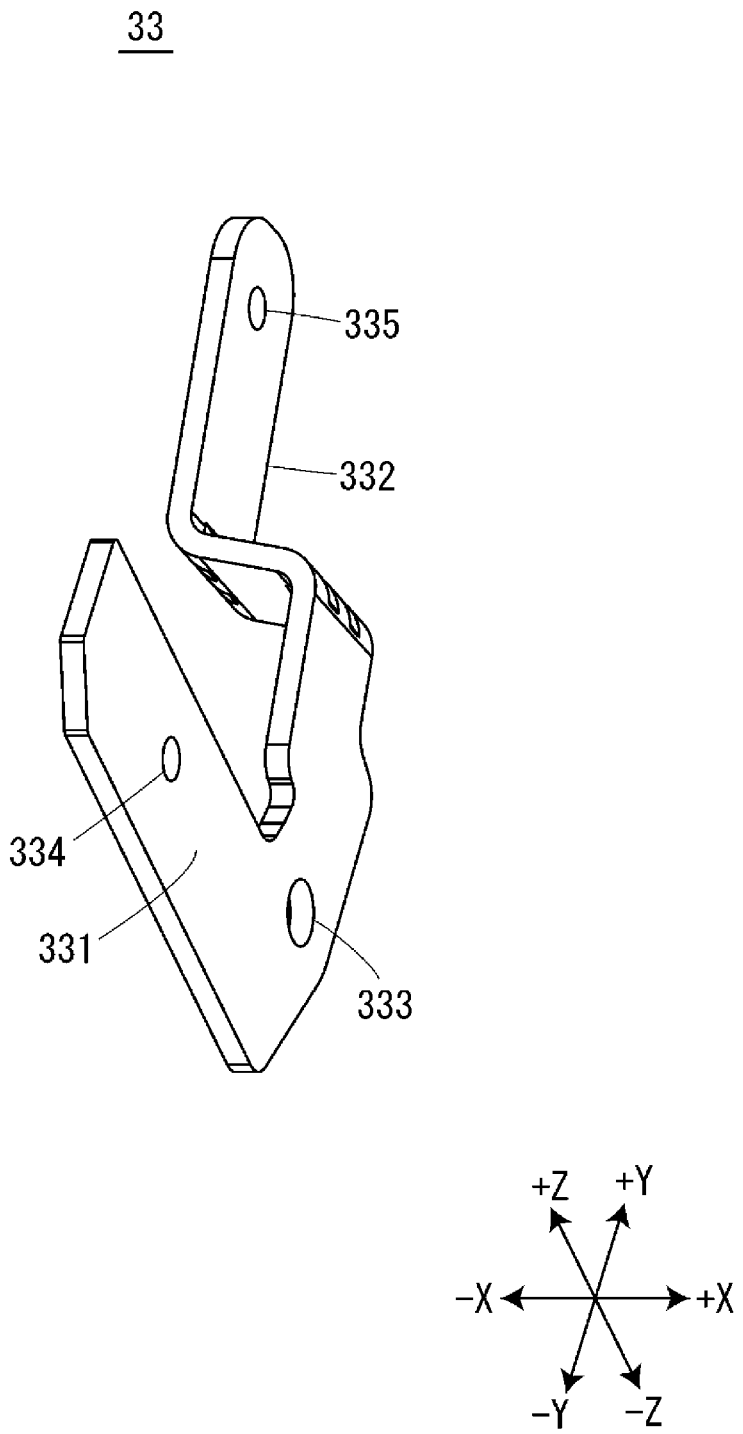
FIG. 10 is a perspective view of a frame.
Figure 11:
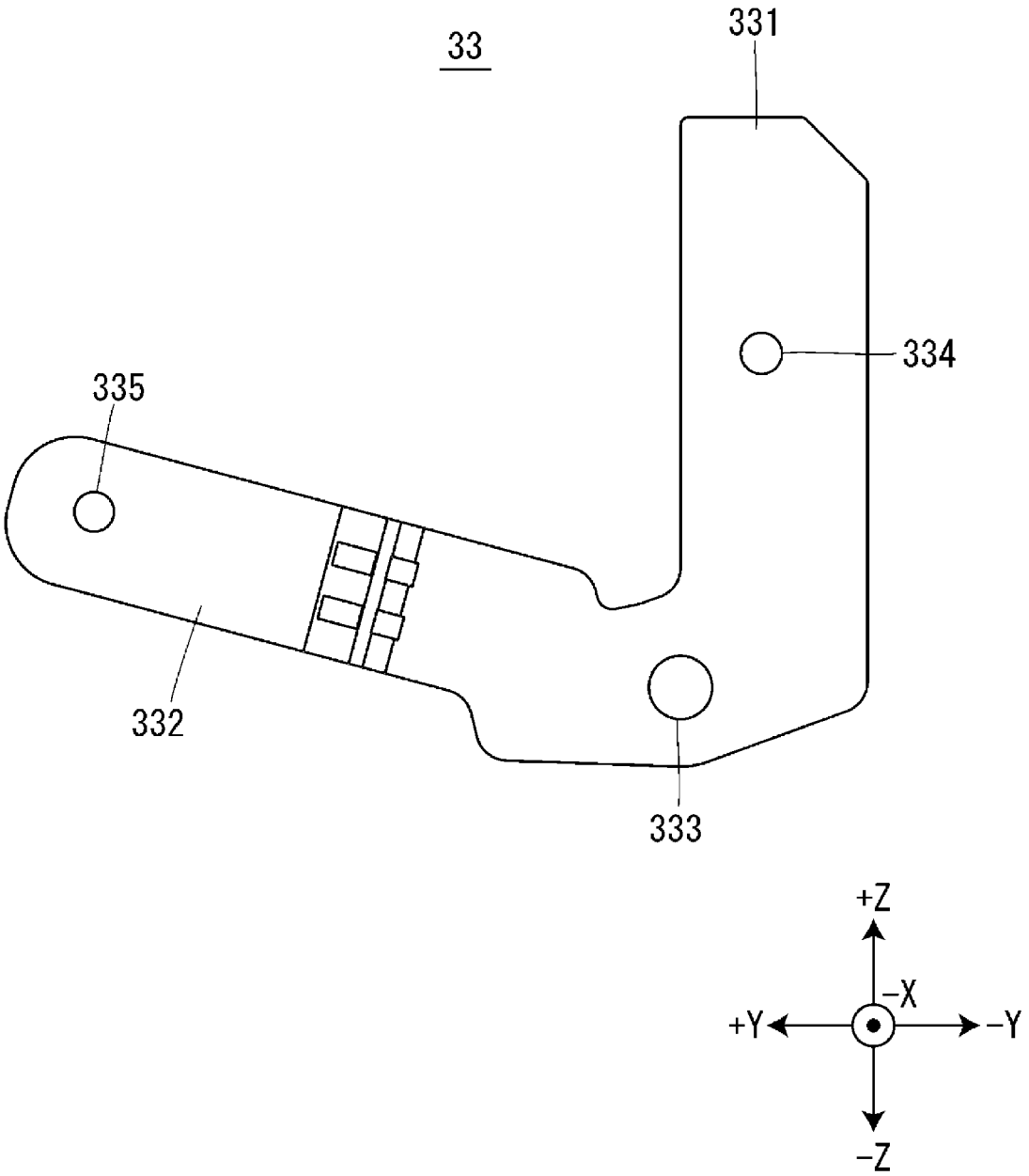
FIG. 11 is a view of the frame when viewed from the −X side.
Figure 12:
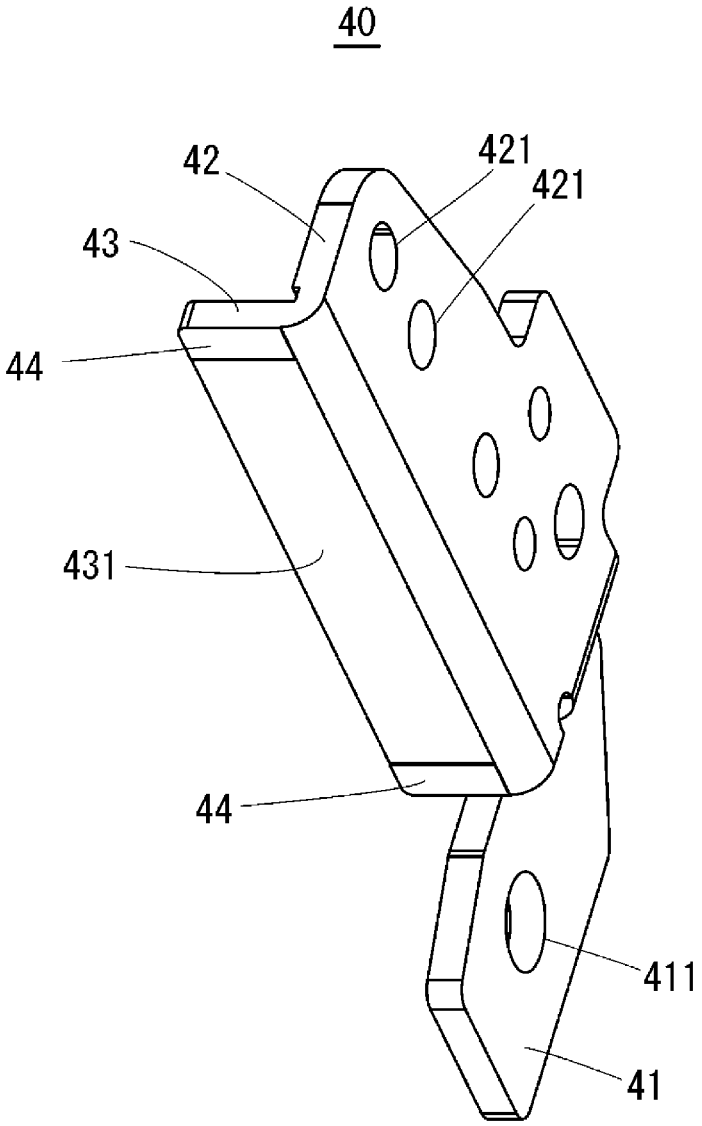
FIG. 12 is a perspective view of a blade receiving member.
Figure 12:
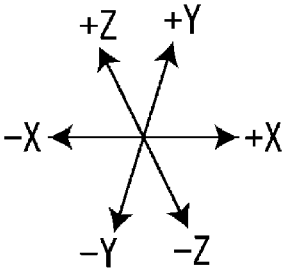
Figure 13:
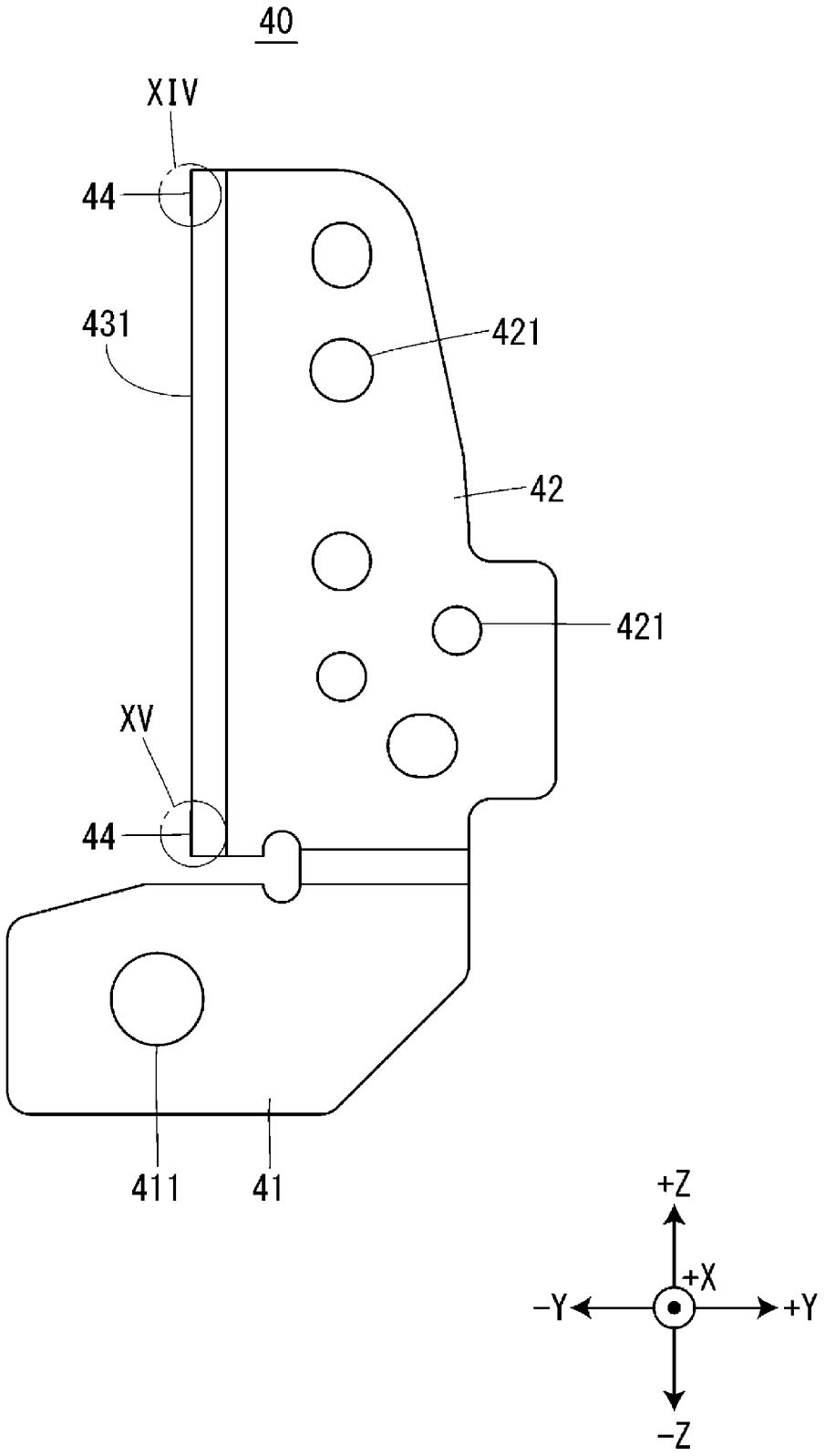
FIG. 13 is a view of the blade receiving member when viewed from the +X side.
Figure 14:
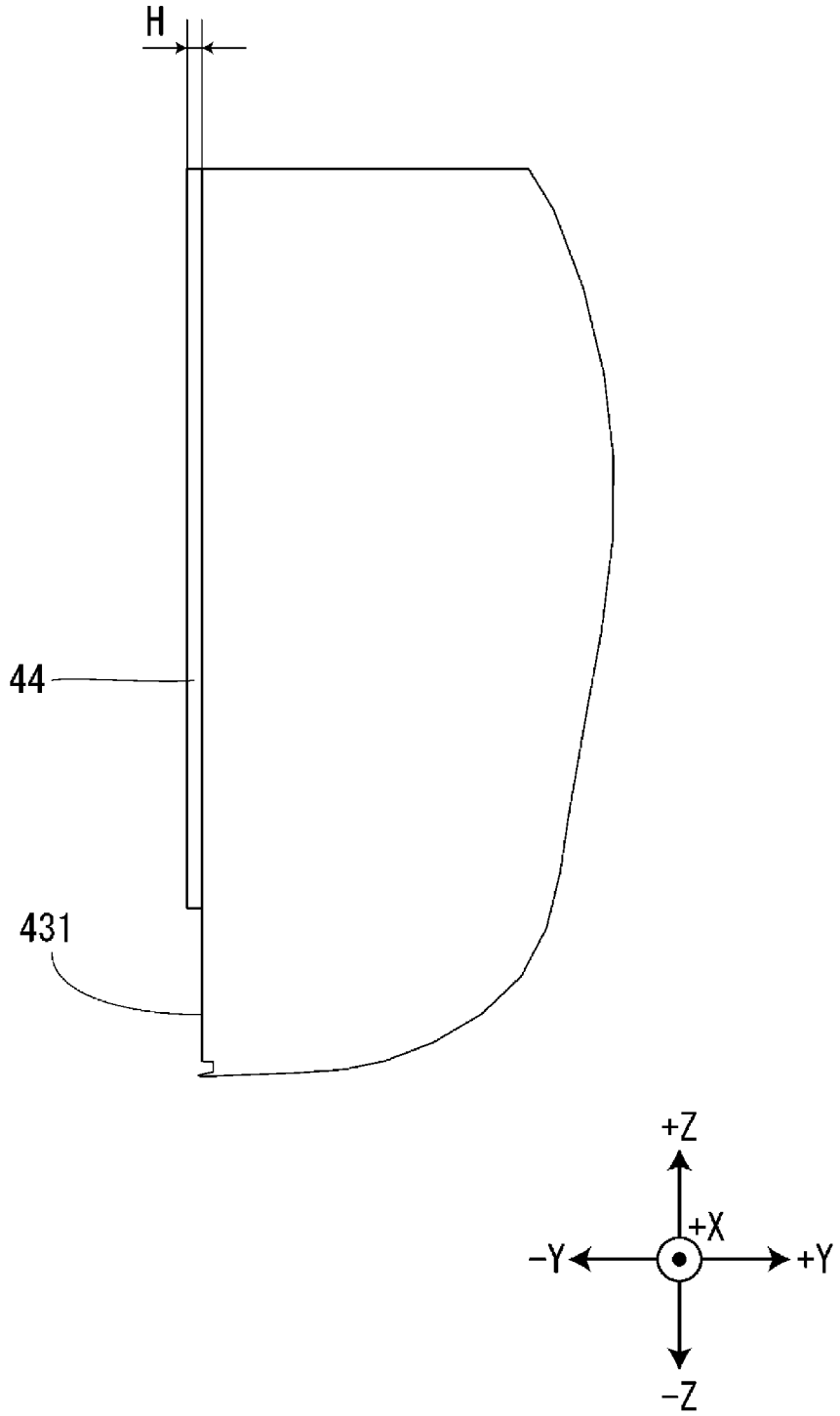
FIG. 14 is a partially enlarged view of a portion indicated by reference numeral XIV in FIG. 13.
Figure 15:
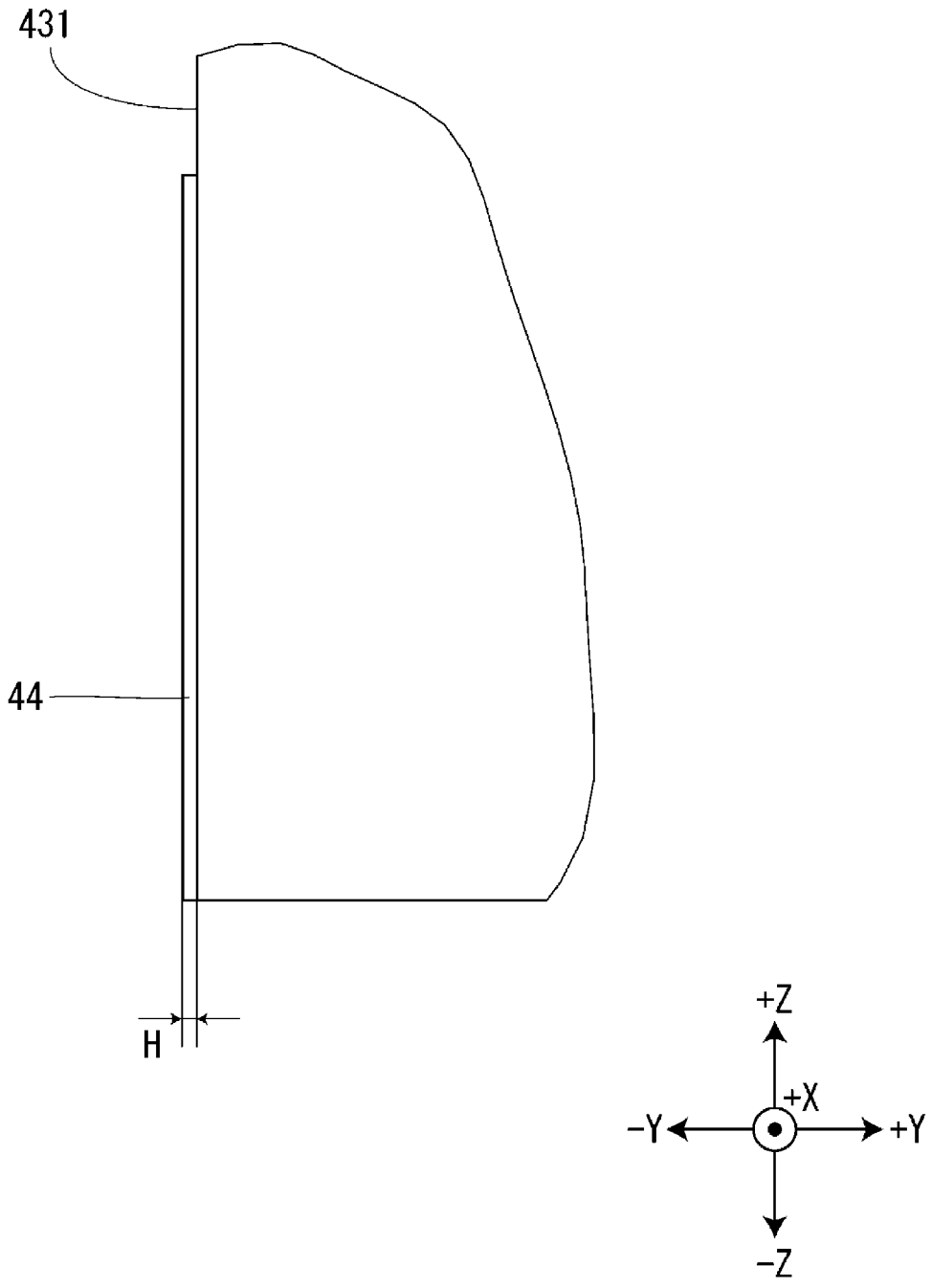
FIG. 15 is a partially enlarged view of a portion indicated by reference numeral XV in FIG. 13.

The frame 33 will be described based on FIGS. 10 and 11. The frame 33 is formed in a substantially inverted "L" shape when viewed from the downstream side (the −X side) of the laminated tape T in the feeding direction, and the bent portion is provided with a cutting hole 333 into which the support shaft 50 is inserted. The frame 33 includes a holder attaching unit 331 and an arm portion 332.

A frame hole 334 into which the attachment pin 34 is inserted is provided at a substantially central portion of the holder attaching unit 331. The holder 32 to which the blade 31 is fixed is attached to a surface of the holder attaching unit 331 on the upstream side (the +X side) of the laminated tape T in the feeding direction. In more detail, the holder 32 is caulked and fixed to the holder attaching unit 331 through the attachment pin 34 inserted into the holder hole 321, the blade hole 312, and the frame hole 334.

An arm hole 335 into which an engagement pin 35 (see FIG. 3) is inserted is provided at a tip end of the arm portion 332. The engagement pin 35 inserted into the arm hole 335 is caulked and fixed to the arm portion 332. The engagement pin 35 is engaged with a gear (not illustrated) to which power from the cutter motor is transmitted. When the cutter motor is operated, the arm portion 332 and the holder attaching unit 331 rotate (more specifically, swing) about the support shaft 50. Accordingly, the blade 31 attached to the holder attaching unit 331 through the holder 32 comes into contact with and is separated from the blade receiving surface 431 of the blade receiving member 40 (see FIGS. 4 and 5).

The blade receiving member 40 will be described with reference to FIGS. 12 to 15. Although the material of the blade receiving member 40 is not particularly limited, the blade receiving member 40 is made of, for example, stainless steel. The blade receiving member 40 includes a baes portion 41, a fixing portion 42, and a reception portion 43. The blade receiving member 40 is provided such that the blade receiving surface 431 of the reception portion 43 faces the peeling tape 112 side (the +Y side) of the laminated tape T sent to the half cutter 20.

The base portion 41 is provided with a blade receiving hole 411 into which the support shaft 50 is inserted. The blade receiving member 40 and the cutting blade 30 are caulked and fixed to each other through the support shaft 50 inserted into the blade receiving hole 411 and the cutting hole 333.

The fixing portion 42 is provided with a plurality of fixing holes 421. Fixing screws for fixing the blade receiving member 40 to a cutter fixing member which is not illustrated are inserted into the fixing holes 421.

The reception portion 43 has the blade receiving surface 431 which the blade 31 of the cutting blade 30 comes into contact with and is separated from. The blade receiving surface 431 is formed in a substantially rectangular shape that is long in the Z direction. The blade receiving surface 431 is provided with a spacer. The spacer includes two blade receiving spacers 44 arranged at the blade receiving surface 431. The two blade receiving spacers 44 are provided to be spaced apart from each other in the longitudinal direction (the Z direction) of the blade receiving surface 431, that is, in a cutting edge direction of the blade 31 coming close to the blade receiving surface 431. In more detail, the blade receiving spacers 44 are provided (in the present embodiment, at both ends of the blade receiving surface 431) to be spaced apart from each other to ensure a distance corresponding to the width of the laminated tape T in the longitudinal direction (the Z direction) of the blade receiving surface 431. The blade receiving spacers 44 are made of a material (for example, a material containing nickel as a main component) that is different from the blade receiving member 40 and are provided to protrude from the blade receiving surface 431. The protrusion height H of the blade receiving spacers 44 is substantially equal to the thickness B of the peeling tape 112, and is, for example, 0.04 mm (see FIGS. 14 and 15).

Figure 16:
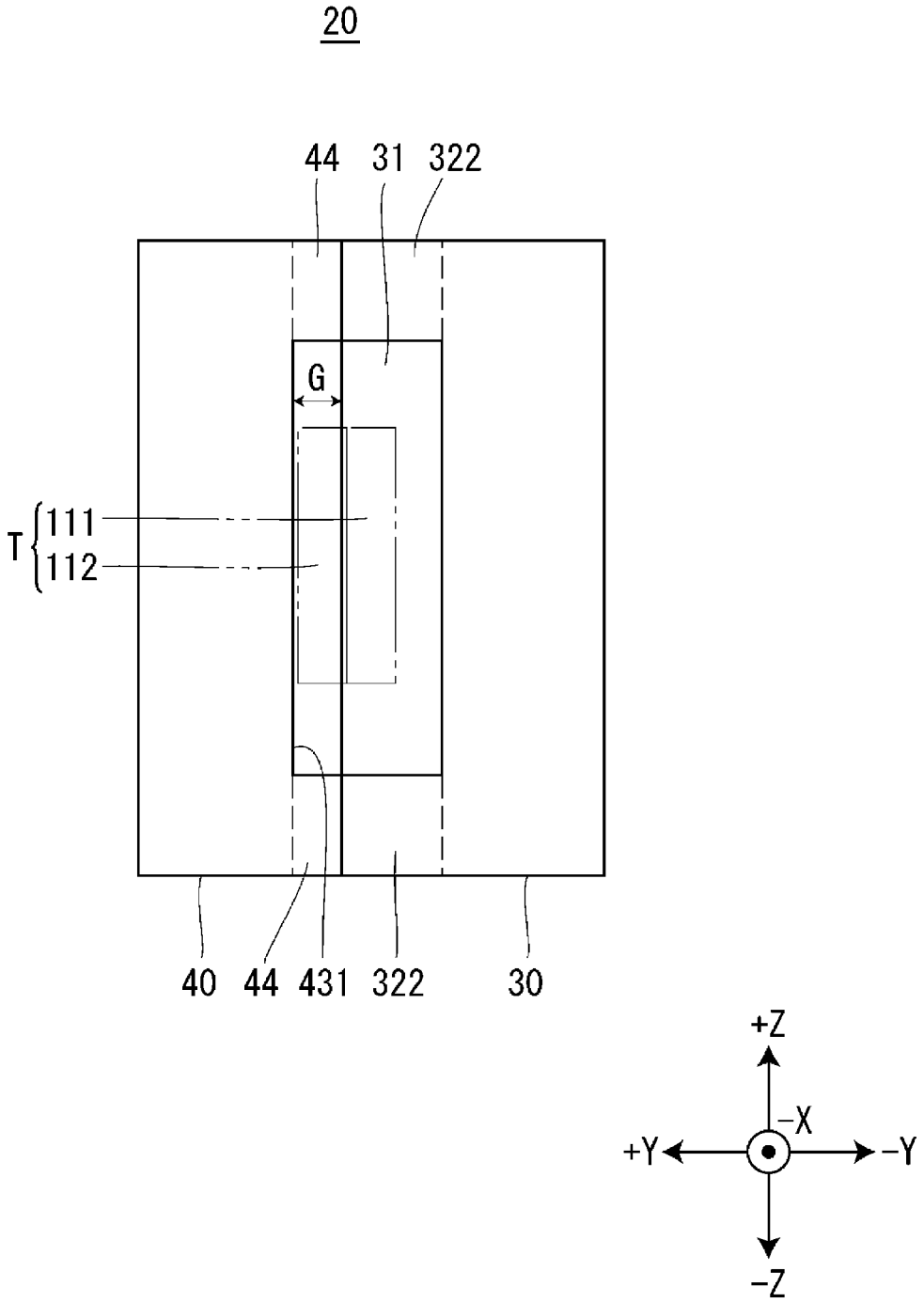
FIG. 16 is a view schematically illustrating n a state in which the blade comes close to the blade receiving surface in the half cutter.

As illustrated in FIG. 16, in the half cutter 20 configured above, when the cutting blade 30 rotates about the blade receiving member 40 and the blade 31 comes close to the blade receiving surface 431, the two holder protrusion portions 322 provided in the holder 32 to which the blade 31 is fixed comes into contact with the two blade receiving spacers 44 provide on the blade receiving surface 431. At this time, a gap G that is substantially equal to the thickness B of the peeling tape 112 is generated between the blade 31 and the blade receiving surface 431. In other words, the blade receiving spacers 44 generates the gap G between the blade 31 and the blade receiving surface 431 in a state in which the blade 31 comes close to the blade receiving surface 431, that is, in a state in which the holder protrusion portions 322 come into contact with the blade receiving spacers 44.

As described above, the blade receiving surface 431 is provided with the two blade receiving spacers 44 spaced apart from each other in the cutting edge direction of the blade 31 that comes close to the blade receiving surface 431. Thus, the gap G between the blade 31 and the blade receiving surface 431 can be properly formed throughout the entire cutting edge direction of the blade 31. In more detail, as described above, the holder 32 is attached to the holder attaching unit 331 to be rotatable about the attachment pin 34. Thus, when the two holder protrusion portions 322 come into contact with the two blade receiving spacers 44 provided on the blade receiving surface 431, an attachment error of the holder 32 with respect to the holder attaching unit 331 is offset. It is preferable that the blade receiving surface 431 is formed flatly such that the gap G between the blade 31 and the blade receiving surface 431 is uniform. In detail, it is preferable that the flatness is equal to or less than 0.01 mm.

In this way, in a state in which the blade 31 comes close to the blade receiving surface 431, the blade 31 receives the blade receiving surface 431 to cut the laminate tape T from the printing tape 111 side. However, as the gap G is generated between the blade 31 and the blade receiving surface 431, the blade 31 does not reach the peeling tape 112 or reaches only a halfway portion in the thickness direction of the peeling tape 112. Accordingly, the half cutter 20 forms the cut C (see FIG. 2) on a surface on the printing tape 111 side (the −Y side) without cutting the laminated tape T. The user can easily peel off the peeling tape 112 from the printing tape 111 using the cut C formed in the laminated tape T as a hint. The half cutter 20 may have a configuration in which the cut C is formed on a surface of the laminated tape T on the peeling tape 112 side (the +Y side). That is, the half cutter 20 may be provided such that the blade 31 faces the peeling tape 112 side (the +Y side) of the laminated tape T and may be provided such that the blade receiving surface 431 faces the printing tape 111 side (the −Y side).

Here, a method of forming the blade receiving spacers 44 on the blade receiving surface 431 will be described. For example, the press working is considered as the method of forming the blade receiving spacers 44 on the blade receiving surface 431. However, in this case, the protrusion height H of the blade receiving spacers 44 easily deviates from the dimensional tolerance due to a dimensional error of a mold used for the press working or a dimensional error during pressing. Therefore, the gap G between the blade 31 and the blade receiving surface 431 deviates from an appropriate value, and thus, the laminated tape T cannot be half-cut appropriately. That is, when the protrusion height H of the blade receiving spacers 44 is large and the gap G between the blade 31 and the blade receiving surface 431 is large, the cut C cannot be formed in the laminated tape T. Meanwhile, when the protrusion height H of the blade receiving spacers 44 is small and the gap G between the blade 31 and the blade receiving surface 431 is small, the laminated tape T is fully cut, that is, the laminated tape T is cut.

Thus, in the half cutter 20 of the present embodiment, the blade receiving spacers 44 are formed on the blade receiving surface 431 by an electroless nickel plating treatment.

Figure 17:
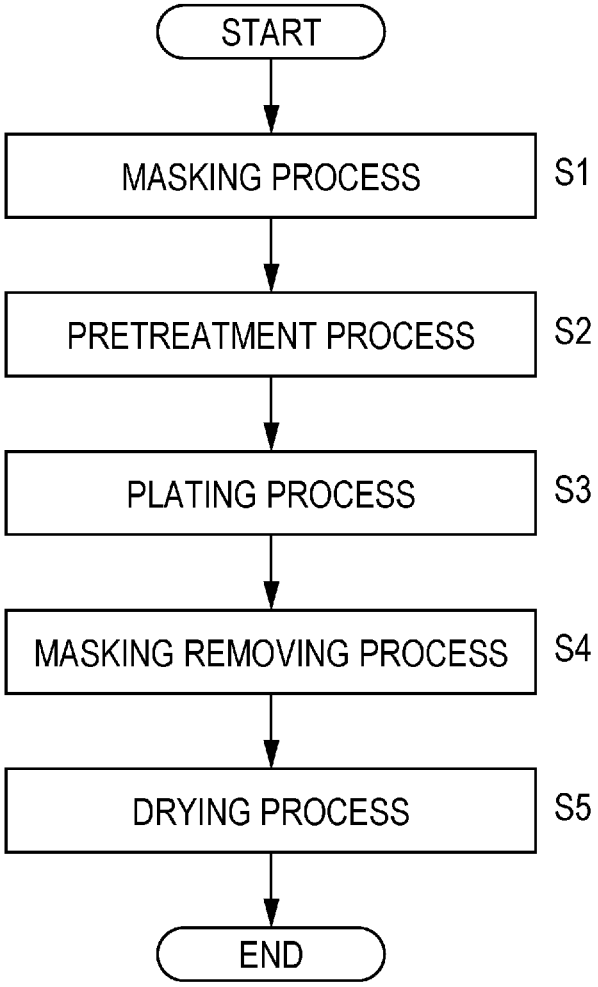
FIG. 17 is a view illustrating a step of forming a spacer on the blade receiving surface.

Each process of the electroless nickel plating treatment will be described with reference to FIG. 17. First, in a masking process of step S1, the blade receiving member 40 in which the blade receiving spacers 44 are not formed is masked except for both ends of the blade receiving surface 431 in the longitudinal direction. The type of the masking is not particularly limited. For example, a tape or a paint can be used.

In a pretreatment process of step S2, after the blade receiving member 40 is attached to a jig, processes such as a degreasing process, an electrolytic degreasing process, and an acid activation process are performed.

In a plating treatment of step S3, the blade receiving member 40 is immersed in a plating solution, and the electroless nickel plating treatment is performed. Accordingly, a plating film that functions as the blade receiving spacers 44 is formed at a portion where the masking is not performed, that is, at both ends of the blade receiving surface 431 in the longitudinal direction. The film thickness of the plating film, that is, the protrusion height H of the blade receiving spacers 44 can be adjusted, for example, by increasing or decreasing a time of the plating treatment. Thus, by forming the blade receiving spacers 44 by the plating treatment, dimensional accuracy of the protrusion height H of the blade receiving spacers 44 can be improved. The plating treatment is not limited to the electroless plating treatment, and may be, for example, an electroplating treatment. In general, the electroless plating treatment is preferable since dimensional accuracy of the film thickness is high. Further, metal used for the plating treatment is not limited to nickel, and for example, copper or cobalt may be used.

In a masking removing process of step S4, the blade receiving member 40 is removed from the jig, and the masked portion is removed from the blade receiving member 40.

In a drying process of step S5, the drying process is performed by blowing air.

Here, the masking method is used as a partial plating treatment method, that is, a method of plating only both ends of the blade receiving surface 431 of the blade receiving member 40 in a longitudinal direction. However, the present invention is not limited thereto, and for example, a brush plating method may be used.

As described above, the half cutter 20 of the present embodiment includes the cutting blade 30, the blade receiving member 40, and the blade receiving spacers 44. The cutting blade 30 has the blade 31 and the holder 32 to which the blade 31 is fixed. The blade receiving member 40 has the blade receiving surface 431 which the blade 31 is separated from and comes into contact with. The blade receiving spacers 44 are made of a material that is different from that of the blade receiving member 40 and are provided to protrude from the blade receiving surface 431. The blade receiving spacers 44 generate the gap G between the blade 31 and the blade receiving surface 431 in a state in which the blade 31 comes close to the blade receiving surface 431.

With this configuration, since the blade receiving spacers 44 are provided on the blade receiving surface 431 using a material that is different from that of the blade receiving member 40, the protrusion height H of the blade receiving spacers 44 is prevented from deviating from a dimensional tolerance (for example, ±0.015 mm). That is, a variation in the protrusion height H of the blade receiving spacers 44 between the plurality of half cutters 20 is suppressed. Therefore, the gap G between the blade 31 and the blade receiving surface 431 can be prevented from deviating from an appropriate value, and the laminated tape T can be appropriately half-cut. In other words, a defect rate in a manufacturing process of the half cutter 20 can be reduced. Further, the blade receiving spacers 44 are provided on the blade receiving surface 431 using a material that is different from that of the blade receiving member 40. Thus, for example, even when the specification of the thickness B of the peeling tape 112 is changed, it is possible to easily cope with the change. In other words, the laminated tape T can be appropriately half-cut by changing the protrusion height H of the blade receiving spacers 44 without changing the configurations of the holder 32 and the blade receiving member 40.

The present invention is not limited to the above-described embodiment, and various configurations can be adopted without departing from the spirit of the present invention. For example, the above-described embodiment can be changed to the following form in addition to the above-described matter.

Figure 18:
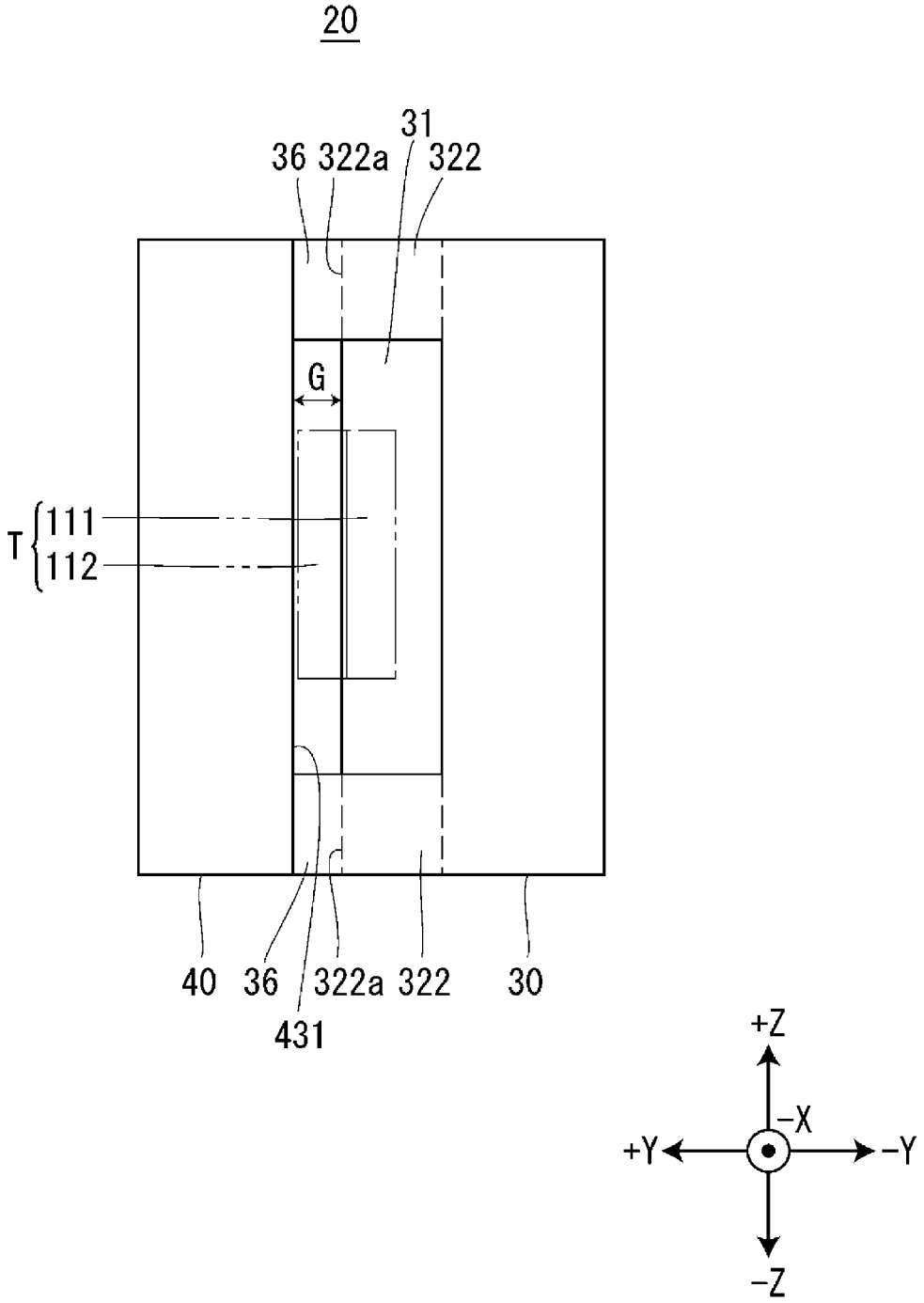
FIG. 18 is a view schematically illustrating n a state in which the blade comes close to the blade receiving surface in the half cutter according to a first modification.

A first modification of the half cutter 20 will be described based on FIG. 18. Although the half cutter 20 of the first modification has substantially the same configuration as the above-described half cutter 20, there is difference in that the spacer includes two holder spacers 36 arranged at the holder 32 instead of the two blade receiving spacers 44. That is, the two holder spacers 36 are made of a material that is different from that of the holder 32 and are provided on the tip end surfaces 322*a* of the holder protrusion portions 322 to protrude further toward the blade receiving surface 431 side (the +Y side) than toward the blade 31.

Figure 19:
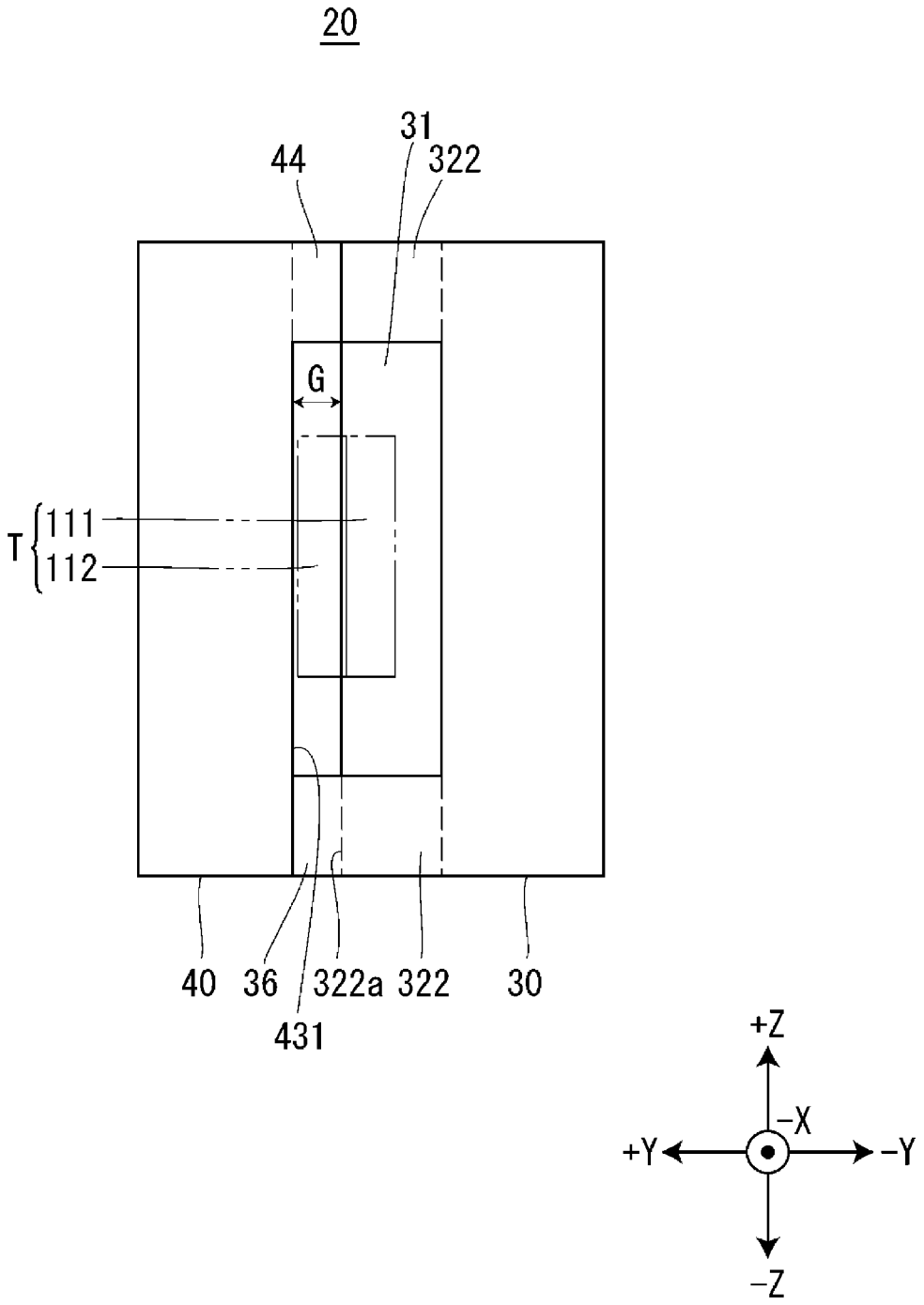
FIG. 19 is a view schematically illustrating n a state in which the blade comes close to the blade receiving surface in the half cutter according to a second modification.

A second modification of the half cutter 20 will be described based on FIG. 19. Although the half cutter 20 of the second modification has substantially the same configuration as the above-described half cutter 20, there is difference in that the spacer includes one blade receiving spacer 44 and one holder spacer 36 instead of the two blade receiving spacers 44. The blade receiving spacer 44 is provided far from the support shaft 50, and the holder spacer 36 is provided close to the support shaft 50. The blade receiving spacer 44 may be provided close to the support shaft 50, and the holder spacer 36 may be provided far from the support shaft 50.

As illustrated in the first modification and the second modification, with regard to the spacer, the present invention is not limited to the configuration including the two blade receiving spacers 44. The present invention may be configured to include the two holder spacers 36 or may be configured to include the blade receiving spacer 44 and the holder spacer 36. Similar to the blade receiving spacers 44, the holder spacers 36 can be formed by performing, for example, a plating treatment on the tip end surfaces 322*a* of the holder protrusion portions 322. In general, the blade receiving surface 431 is wider than the tip end surfaces 322*a* of the holder protrusion portions 322. Thus, a case where the blade receiving spacers 44 are formed on the blade receiving surface 431 is easier than a case where the holder spacers 36 are formed on the tip end surfaces 322*a* of the holder protrusion portions 322. Further, the number of the spacers is not limited two, but may be one or three or more. However, in a case where the blade receiving spacers 44 are provided on the blade receiving surface 431, as in PTL 1, when a configuration is provided in which a part of the cutting edge 311 of the blade 31 and the blade receiving spacers 44 are in contact with each other, there is a fear in that the cutting edge 311 is worn at a contact portion, and the gap G changes over time. Therefore, when the blade receiving spacers 44 are provided on the blade receiving surface 431, it is preferable that the cutting edge 311 of the blade 31 and the blade receiving spacers 44 are not in contact with each other.

The spacers, that is, the blade receiving spacers 44 and the holder spacers 36 are not limited to the plating treatment, and may be formed by other surface treatments. For example, thermal spraying (more specifically, ceramic spraying, carbide metal spraying, and the like), coating (more specifically, fluorine resin coating, and the like), an ink jet forming process, and the like can be used as other surface treatments. When the spacer is formed by the thermal spraying, durability and wear resistance of the spacer can be improved. When the spacer is formed by the coating, manufacturing costs can be reduced. The ink jet forming process is a process of forming the spacer by ejecting a liquid containing, for example, metal particles by an ink jet method. When the spacer is formed by the ink jet forming process, the dimensional accuracy of the protrusion height H of the spacer can be improved. Furthermore, the spacer may be formed by a method other than the surface treatment. For example, the spacer may be formed by attaching a metal foil to the blade receiving surface 431 or the holder 32. Further, the spacer may be formed by combining a plurality of these surface treatments and methods other than the surface treatment. Further, when these surface treatments and the method other than the surface treatments are applied to the blade receiving surface 431 or the tip end surfaces 322*a* of the holder protrusion portions 322, a pretreatment such as surface roughening may be performed on a portion where the spacer is formed.

The printing head 5 is an example of a "printing unit". For example, a dot impact method, an ink jet method, or an electrophotographic method in addition to the thermal method such as the printing head 5 may be used as a printing unit.

The laminated tape T is an example of an "object to be cut". The object to be cut may be a single-layered object or an object having a shape other than a tape in addition to the laminated tape T.

The half cutter 20 is not limited to that provided in the tape printing device A, but may be provided in another device or may be used alone.

CROSS REFERENCE TO RELATED APPLICATIONS

This application is a National Stage Entry of International Application No. PCT/JP2018022185, filed on Jun. 11, 2018; which claims priority to Japanese Patent Application No. 2017-121944 filed on Jun. 22, 2017; the entire contents of both of which are incorporated by reference herein.

The invention claimed is:

1. A half cutter comprising:

a cutting blade having a blade, a holder to which the blade is fixed, and a frame that is rotatably attached to the holder;

a blade receiving member having a blade receiving surface from and with which the blade is separated and comes into contact;

a pair of holder protrusion portions that are provided at both ends of the holder, and are flush with a cutting edge of the blade when the blade is fixed to the holder; and a spacer having at least one of a holder spacer which is made of a material that is different from a material of the holder, is formed on the holder to protrude toward the blade receiving surface further than the blade by a first surface treatment, and generates a gap between the blade and the blade receiving surface in a state in which the blade comes close to the blade receiving surface and a blade receiving spacer which is made of a material different from a material of the blade receiving member, is formed to protrude from the blade receiving surface by a second surface treatment, and generates a gap between the blade and the blade receiving surface in a state in which the blade comes close to the blade receiving surface.

2. The half cutter according to claim 1, wherein the spacer has the blade receiving spacer.

3. The half cutter according to claim 2, wherein a plurality of the spacers are provided to be spaced apart from each other in a cutting edge direction of the blade in a state in which the blade comes close to the blade receiving surface.

4. A method of manufacturing a half cutter including a cutting blade having a blade, a holder to which the blade is fixed and a frame that is rotatably attached to the holder, a blade receiving member having a blade receiving surface from and with which the blade is separated and comes into contact, a pair of holder protrusion portions that are provided at both ends of the holder, and are flush with a cutting edge of the blade when the blade is fixed to the holder, and a spacer which generates a gap between the blade and the blade receiving surface in a state in which the blade comes close to the blade receiving surface, the method comprising:

forming the spacer in the holder to protrude toward the blade receiving surface further than the blade with a material that is different from a material of the holder by a first surface treatment or forming the spacer to protrude from the blade receiving surface with a material that is different from a material of the blade receiving member by a second surface treatment.

5. The method according to claim 4, wherein the first surface treatment and the second surface treatment are a plating, a thermal spraying, a coating or an ink jet forming process.

6. A tape printing device comprising:

a printing unit that performs printing on a printing tape of a laminated tape having the printing tape and a peeling tape laminated on the printing tape; and a half cutter that forms a cut on a surface of one of the printing tape and the peeling tape with respect to the laminated tape, wherein the half cutter includes a cutting blade having a blade, a holder to which the blade is fixed and a frame that is rotatably attached to the holder, a blade receiving member having a blade receiving surface from and with which the blade is separated and comes into contact, a pair of holder protrusion portions that are provided at both ends of the holder, and are flush with a cutting edge of the blade when the blade is fixed to the holder, and a spacer having at least one of a holder spacer which is made of a material that is different from a material of the holder, is formed in the holder to protrude toward the blade receiving surface further than the blade by a first surface treatment, and generates a gap between the blade and the blade receiving surface in a state in which the blade comes close to the blade receiving surface and a blade receiving spacer which is made of a material different from a material of the blade receiving member, is formed to protrude from the blade receiving surface by a second surface treatment, and generates a gap between the blade and the blade receiving surface in a state in which the blade comes close to the blade receiving surface.

* * * * *